United States Patent [19]

Nieto

[11] Patent Number: 4,558,547

[45] Date of Patent: Dec. 17, 1985

[54] ANCHORING DEVICE FOR A PRE-STRESS CABLE

[75] Inventor: Jean-Francois A. Nieto, Rio de Janiero, Brazil

[73] Assignee: Freyssinet International (STUP) S.A., Boulogne-Billancourt, France

[21] Appl. No.: 602,464

[22] Filed: Apr. 20, 1984

[30] Foreign Application Priority Data

Apr. 22, 1983 [BR] Brazil ..... 8302084

[51] Int. Cl.[4] ..... E04C 5/08

[52] U.S. Cl. ..... 52/223 L; 24/122.3

[58] Field of Search ..... 52/223 R, 223 L, 230; 24/122.3, 122.6, 114.5, 136 R; 403/369, 374, 19, 20; 29/446, 452

[56] References Cited

U.S. PATENT DOCUMENTS 3,060,639 10/1962 Fields et al. ..... 52/223 R 3,226,934 1/1966 Emery ..... 52/223 L

FOREIGN PATENT DOCUMENTS 647378 9/1948 United Kingdom ..... 52/223 L

*Primary Examiner*—James L. Ridgill, Jr.

*Attorney, Agent, or Firm*—Larson and Taylor

[57] ABSTRACT

The invention provides an anchoring device for a pre-stress cable formed from several filaments or strands (4), comprising a bearing plate (1), a block (2) pierced with truncated cone shaped holes ($2_1$) through each of which passes a filament or strand of the cable, said block resting on said plate and truncated cone shaped jaws (3) for jamming the filaments or strands in their holes. The bearing plate (1) is pierced with multiple holes ($1_1$) extending those ($2_1$) of the block (2) so that this plate supports this block over the whole of its non pierced surface.

7 Claims, 3 Drawing Figures

FIG. 1.
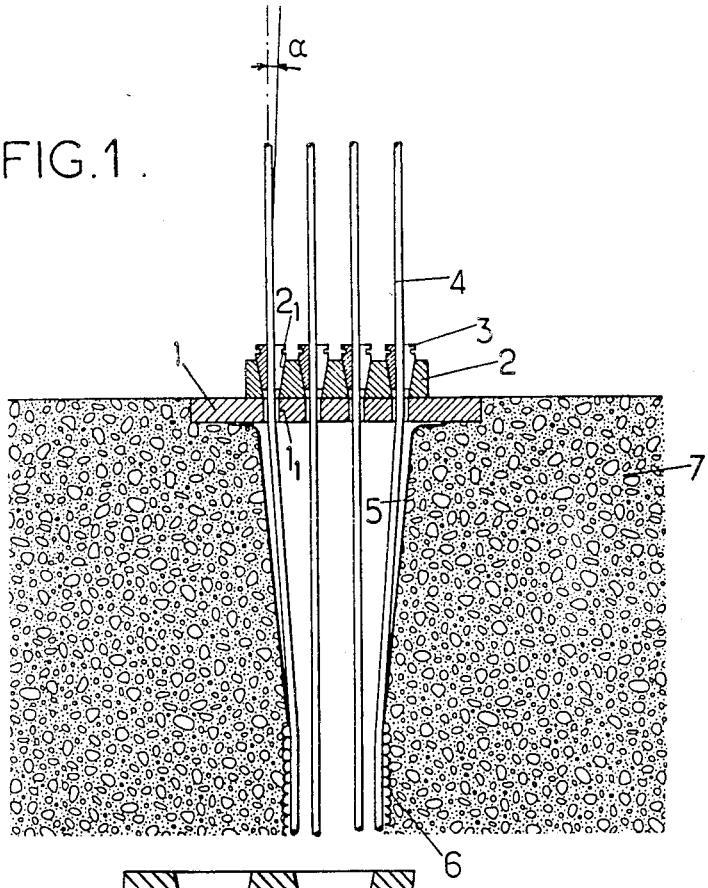
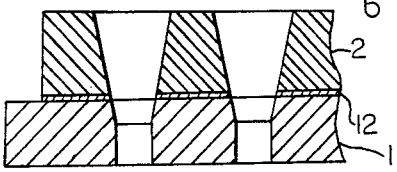
FIG. 3.
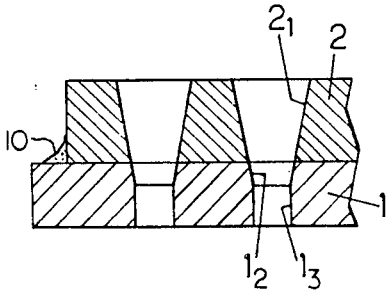
FIG. 2.

ANCHORING DEVICE FOR A PRE-STRESS CABLE

The invention relates to anchoring devices for pre-stress cables formed from several filaments or strands, which devices comprise a bearing plate, an anchoring block pierced with truncated cone shaped holes through each of which passes a filament or strand of the cable, said block resting on the bearing plate, and truncated cone shaped jaws adapted to jam the filaments or strands in the corresponding holes of the block.

In known embodiments of these devices, a single central opening is provided in the bearing plate through which pass all the filaments or strands forming the cable. The edge of this opening the furthest away from the block is connected by a trumpet to the end of the sheath which surrounds the cable.

The block must then have, on the one hand, a relatively large thickness so as to withstand the flexions to which it is subjected by the tension exerted in the cable, considering the empty space created by the opening in the plate and, on the other hand, cross dimensions sufficient to be able to bear against the edge of this opening. In particular, said thickness of the block is not solely determined by the dimensions of the jaws.

To overcome these disadvantages, in accordance with the invention the bearing plate is pierced with multiple holes extending those of the block so that this plate may support this block over the whole of its non pierced surface.

In other words, the bearing plate is not just pierced with a single central opening but with a multitude of holes, in the manner of a "reticulated" or cross-ruled grid or plate.

It is then the assembly of the plate and the block intimately juxtaposed one against the other which withstands the flexions to which the anchoring device is subjected.

With this arrangement, all the dimensions of the anchoring block, and in particular its thickness can be reduced and so its cost.

The respective thickness and natures of the plate and block may of course be altered depending on the needs.

In one advantageous arrangement, the conical shape of the holes for receiving the jaws is extended axially beyond the block, into the plate itself, which allows the ends of the jaws to penetrate into the plate as well, thus providing excellent transverse interlocking of these two parts: the stability in time of their relative transverse positioning is thus ensured.

With the same end in view the mutual adherence between the plate and the block may be improved by causing the facing surfaces of these two pieces to undergo appropriate finishing treatments or by applying an appropriate coating on at least one of these surfaces.

In a variant, the block may be welded to the plate.

In another variant, the assembly of the block and the plate may even be formed as a single part, which allows the resulting single body formed with holes widening out towards the outside to be formed by casting.

The drawings show two embodiments of the invention solely by way of illustration.

FIG. 1, of these drawings, shows an axial section a cable anchoring device in accordance with the invention;

FIG. 2 also shows in axial section the detail of a variant of a device also in accordance with the invention.

FIG. 3 further shows in cross section the detail of a further variant of a device also in accordance with the invention.

The anchoring device shown in FIG. 1 comprises a plate 1 pierced with a multitude of cylindrical holes $1_1$ adapted to extend the different truncated cone shaped holes $2_1$ formed in an anchoring block 2 itself formed by a flat slab of relatively small dimensions.

It is in the holes $2_1$ that the truncated cone shaped jaws 3 clamp the multiple filaments or strands 4 forming the cable to be anchored.

The periphery of the face of plate 1, the furthest away from block 2 is connected by a trumpet 5, whose diameter decreases away from the plate, to the end of a sheath 6 forming the casing for the cable, the sections of the filaments or strands 4 projecting from plate 1 being guided as far as said end by said trumpet which surrounds them. This trumpet 5 and sheath 6 are intended to be embedded in the concrete work 7 which it is desired to pre-stress by tensioning the cable.

It is then against this work 7 that the periphery of the bearing plate 1 bears.

The axes of holes $1_1$ and $2_1$ may diverge outwardly of the work 7, as is usual.

But in the preferred embodiment illustrated, these axes are perpendicular to the bearing plane of plate 1, that is to say parallel to the general axis of the cable: the bores which must be formed in plate 1 and in block 2 so as to obtain holes $1_1$ and $2_1$ are then simplified.

The axes considered could also have a general orientation converging outwardly of work 7, as shown schematically by the angle $\alpha$.

In the variant of FIG. 2, the holes formed in plate 1 each comprise a truncated cone shaped section $1_2$ extending exactly a truncated cone shaped hole $2_1$ of block 2 and the small base of this truncated cone shaped section $1_2$ is connected to a cylindrical section $1_3$ emerging outside the plate on its face the furthest away from block 2. In this variant, block 2 is depicted as being welded to plate 1, as shown at 10.

With such a variant, the small diameter ends of jaws 3 may penetrate into the truncated cone shaped section $1_2$, which provides excellent transverse interlocking between the plate 1 and block 2, thus making relative sliding thereof impossible more especially when they are working under mutual flexion.

In the variant of FIG. 3, the holes are identical to those in FIG. 2. In this variant, however, an appropriate coating 12 is depicted between the faces of plate 1 and block 2 to provide mutual adherence therebetween.

I claim:

1. An anchoring device for a pre-stress cable that is formed of several filaments or strands, the device comprising a bearing plate having a transverse dimension;

a block resting on said bearing plate but which is a separate element from said bearing plate and having a transverse dimension that is less than the transverse dimension of said bearing plate, said block having a plurality of truncated cone shaped holes therethrough through which passes a filament or strand of a cable, said plate having corresponding holes therethrough to said holes in said block, said plate holes extending axially the conical shape of said block holes such that the conical shape of the combined axially oriented holes is extended beyond said block at least into said plate, and said plate supporting said block over the non-pierced surface thereof; and a plurality of truncated cone shaped jaws individual to said combined plate and block holes for jamming the filaments or strands into said combined holes, each said jaw extending axially beyond said block into the plate hole corresponding thereto.

2. The anchoring device according to claim 1, characterized in that the axes of the holes and bores formed in the plate (1) and in the block (2) are parallel to the general direction of the cable.

3. The anchoring device according to claim 1, characterized in that one at least of the mutual bearing surfaces of the plate (1) and of the block (2) is treated or coated so as to improve its adherence against the facing surface.

4. The anchoring device according to claim 3, characterized in that the plate (1) is welded to the block (2).

5. The anchoring device according to claim 3, characterized in that the axes of the holes and bores formed in the plate (1) and in the block (2) are parallel to the general direction of the cable.

6. The anchoring device according to claim 5, characterized in that the plate (1) is welded to the block (2).

7. The anchoring device according to claim 6, characterized in that the axes of the holes and bores formed in the plate (1) and in the block (2) are parallel to the general direction of the cable.

* * * * *